US010354602B2

(12) United States Patent
Hwang et al.

(10) Patent No.: US 10,354,602 B2
(45) Date of Patent: Jul. 16, 2019

(54) METHOD OF DRIVING A DISPLAY PANEL CAPABLE OF COMPENSATING FOR A DIFFERENCE IN CHARGING RATES BETWEEN PIXELS, AND A DISPLAY APPARATUS FOR PERFORMING THE SAME

(71) Applicant: SAMSUNG DISPLAY CO., LTD., Yongin-si, Gyeonggi-Do (KR)

(72) Inventors: Hyunsik Hwang, Hwaseong-si (KR); Yoongu Kim, Seoul (KR); Bongim Park, Hwaseong-si (KR); Byungkook Sim, Hwaseong-si (KR); Ikhyun Ahn, Hwaseong-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 17 days.

(21) Appl. No.: 15/657,920

(22) Filed: Jul. 24, 2017

(65) Prior Publication Data

US 2018/0033381 A1 Feb. 1, 2018

(30) Foreign Application Priority Data

Jul. 29, 2016 (KR) ..... 10-2016-0097581

(51) Int. Cl.
*G09G 3/36* (2006.01)

(52) U.S. Cl.
CPC ..... *G09G 3/3607* (2013.01); *G09G 3/3677* (2013.01); *G09G 3/3688* (2013.01); *G09G 2310/027* (2013.01); *G09G 2310/066* (2013.01); *G09G 2310/08* (2013.01); *G09G 2320/0223* (2013.01)

(58) Field of Classification Search
CPC .. G09G 3/3607; G09G 3/4677; G09G 3/3688; G09G 2320/0223; G09G 2310/08; G09G 2310/066; G09G 2310/027
See application file for complete search history.

(56) References Cited

U.S. PATENT DOCUMENTS 8,674,923 B2 3/2014 Tanaka et al.
2004/0036670 A1 2/2004 Chung
(Continued)

FOREIGN PATENT DOCUMENTS

KR 1020120120517 2/2012
KR 10-2015-0010844 1/2015
(Continued)

OTHER PUBLICATIONS

European Search Report dated Oct. 10, 2017 for Application No. 17183742.0.
(Continued)

*Primary Examiner* — Kwang-Su Yang
(74) *Attorney, Agent, or Firm* — F. Chau & Associates, LLC

(57) ABSTRACT

A method of driving a display panel includes outputting a gate signal to the display panel, varying a slew rate of a data voltage to be output to the display panel according to a position in the display panel at which the data voltage is to be applied, outputting the data voltage having the varied slew rate to the display panel, and displaying a grayscale on the display panel in response to the gate signal and the data voltage having the varied slew rate.

19 Claims, 13 Drawing Sheets

(56) References Cited

U.S. PATENT DOCUMENTS

| | | | | |
|---|---|---|---|---|
| 2008/0129718 | A1 | 6/2008 | Nishimura et al. | |
| 2009/0033817 | A1* | 2/2009 | Ooida | G02F 1/1368 349/43 |
| 2009/0128540 | A1 | 5/2009 | Hsu | |
| 2012/0280965 | A1* | 11/2012 | Lee | G09G 3/3677 345/212 |
| 2013/0314392 | A1* | 11/2013 | Kim | G09G 3/20 345/212 |
| 2014/0375703 | A1* | 12/2014 | Ban | G09G 3/3688 345/691 |
| 2015/0103104 | A1* | 4/2015 | Lee | G09G 3/3648 345/690 |
| 2018/0204889 | A1* | 7/2018 | Yu | G09G 3/3233 |

FOREIGN PATENT DOCUMENTS

| | | |
|---|---|---|
| KR | 10-2015-0015957 | 2/2015 |
| KR | 10-2015-0055253 | 5/2015 |

OTHER PUBLICATIONS

Office Action dated Jan. 11, 2019 from the European Patent Office for corresponding European Patent Application No. 17183742.0.

* cited by examiner

METHOD OF DRIVING A DISPLAY PANEL CAPABLE OF COMPENSATING FOR A DIFFERENCE IN CHARGING RATES BETWEEN PIXELS, AND A DISPLAY APPARATUS FOR PERFORMING THE SAME

CROSS-REFERENCE TO RELATED APPLICATIONS

This application claims priority under 35 U.S.C. § 119 to Korean Patent Application No. 10-2016-0097581, filed on Jul. 29, 2016, the disclosure of which is herein incorporated by reference in its entirety.

TECHNICAL FIELD

Exemplary embodiments of the present inventive concept relate to a method of driving a display panel and a display apparatus for performing the method. More particularly, exemplary embodiments of the present inventive concept relate to a method of driving a display panel capable of compensating for a difference of charging rates between pixels due to, for example, resistance of a signal wiring, which may improve a display quality of the display panel, and a display apparatus for performing the method.

DISCUSSION OF THE RELATED ART

A display apparatus typically includes a display panel and a display panel driver. The display panel includes a plurality of gate lines, a plurality of data lines, and a plurality of pixels. The display panel driver includes a gate driver that provides gate signals to the gate lines and a data driver that provides data voltages to the data lines.

The pixel displays a grayscale in response to the gate signal and the data voltage. The gate signal and the data voltage may be delayed according to positions of the pixels in the display panel, resulting in a difference of the charging rates between the pixels according to the positions of the pixels in the display panel.

SUMMARY

Exemplary embodiments of the present inventive concept provide a method of driving a display panel that compensates for a difference of charging rates between pixels due to, for example, resistance of a signal wiring, to improve a display quality of the display panel.

Exemplary embodiments of the present inventive concept further provide a display apparatus for performing the above-described method.

In an exemplary embodiment, a method of driving a display panel includes outputting a gate signal to the display panel, outputting a data voltage having a slew rate varied according to a position in the display panel to the display panel, and displaying a grayscale in response to the gate signal and the data voltage.

In an exemplary embodiment, a method of driving a display panel includes outputting a gate signal to the display panel, varying a slew rate of a data voltage to be output to the display panel according to a position in the display panel at which the data voltage is to be applied, outputting the data voltage having the varied slew rate to the display panel, and displaying a grayscale on the display panel in response to the gate signal and the data voltage having the varied slew rate.

In an exemplary embodiment, the slew rate of the data voltage increases as a distance from a data driver increases.

In an exemplary embodiment, the slew rate of the data voltage linearly increases as the distance from the data driver increases.

In an exemplary embodiment, the slew rate of the data voltage nonlinearly increases as the distance from the data driver increases. A change of the increase of the slew rate of the data voltage increases as the distance from the data driver increases.

In an exemplary embodiment, the slew rate of the data voltage is determined according to the position in the display panel and according to an image pattern displayed on the display panel.

In an exemplary embodiment, the method further includes decreasing the slew rate of the data voltage in response to the data voltage being applied to a single data line, and in response to the data voltage being applied to the single data line repetitively increasing and decreasing according to the image pattern displayed on the display panel.

In an exemplary embodiment, the slew rate of the data voltage increases as a distance from a gate driver increases.

In an exemplary embodiment, the slew rate of the data voltage increases as a distance from a data driver increases and as a distance from a gate driver increases.

In an exemplary embodiment, a gate driver includes a plurality of stages, and the method further includes varying a slew rate of a gate clock signal according to a position of the stages, and outputting the gate clock signal having the varied slew rate to the gate driver.

In an exemplary embodiment, a timing controller outputs the gate clock signal to the gate driver, and the slew rate of the gate clock signal increases as a distance from the timing controller to the stages of the gate driver increases.

In an exemplary embodiment, a display apparatus includes a display panel, a gate driver, and a data driver. The display panel is configured to receive a gate signal and a data voltage and to display a grayscale in response to the gate signal and the data voltage. The gate driver is configured to output the gate signal to the display panel. The data driver is configured to output the data voltage having a slew rate varied according to a position in the display panel to the display panel.

In an exemplary embodiment, a display apparatus includes a display panel, a timing controller, a gate driver, and a data driver. The timing controller is configured to vary a slew rate of a data voltage to be output to the display panel according to a position in the display panel at which the data voltage is to be applied. The gate driver is configured to output a gate signal to the display panel. The data driver is configured to output the data voltage having the varied slew rate to the display panel. The display panel is configured to display a grayscale in response to the gate signal and the data voltage having the varied slew rate.

In an exemplary embodiment, the slew rate of the data voltage increases as a distance from the data driver increases.

In an exemplary embodiment, the slew rate of the data voltage linearly increases as the distance from the data driver increases.

In an exemplary embodiment, the slew rate of the data voltage nonlinearly increases as the distance from the data driver increases. A change of the increase of the slew rate of the data voltage increases as the distance from the data driver increases.

In an exemplary embodiment, the slew rate of the data voltage is determined according to the position in the display panel and according to an image pattern displayed on the display panel.

In an exemplary embodiment, the timing controller is configured to decrease the slew rate of the data voltage in response to the data voltage being applied to a single data line, and in response to the data voltage being applied to the single data line repetitively increasing and decreasing according to the image pattern displayed on the display panel.

In an exemplary embodiment, the slew rate of the data voltage increases as a distance from the gate driver increases.

In an exemplary embodiment, the slew rate of the data voltage increases as a distance from the data driver increases and as a distance from the gate driver increases.

In an exemplary embodiment, the gate driver includes a plurality of stages, and the timing controller is further configured to vary a slew rate of a gate clock signal according to a position of the stages, and output the gate clock signal having the varied slew rate to the gate driver.

In an exemplary embodiment, the slew rate of the gate clock signal increases as a distance from the timing controller to the stages of the gate driver increases.

In an exemplary embodiment a display apparatus includes a display panel, a gate driver, and a data driver. The display panel includes a first pixel and a second pixel connected to a same data line. The gate driver is configured to output the gate signal to the display panel. The data driver is configured to output the data voltage to the display panel. A first distance between the first pixel and the data diver is less than a second distance between the second pixel and the data driver. A first slew rate of a first data voltage applied to the first pixel is less than a second slew rate of a second data voltage applied to the second pixel.

In an exemplary embodiment, a display apparatus includes a display panel, a gate driver, and a data driver. The display panel is configured to receive a gate signal and a data voltage and to display a grayscale in response to the gate signal and the data voltage. The gate driver is configured to output the gate signal having a slew rate varied according to a position in the display panel to the display panel. The data driver is configured to output the data voltage to the display panel.

In an exemplary embodiment, a display apparatus includes a display panel, a timing controller, a gate driver, and a data driver. The timing controller is configured to vary a slew rate of a gate signal to be output to the display panel according to a position in the display panel at which the gate signal is to be applied. The gate driver is configured to output the gate signal having the varied slew rate to the display panel. The data driver is configured to output a data voltage to the display panel. The display panel is configured to display a grayscale in response to the gate signal having the varied slew rate and the data voltage.

In an exemplary embodiment, the gate driver is integrated on the display panel, the gate driver includes a plurality of stages, and the timing controller is further configured to vary a slew rate of a gate clock signal according to a position of the stages and output the gate clock signal having the varied slew rate to the gate driver.

In an exemplary embodiment, the slew rate of the gate clock signal increases as a distance from the timing controller increases.

In an exemplary embodiment, a method of driving a display panel includes outputting a plurality of gate signals to the display panel, and setting a slew rate of each of a plurality of data voltages to be output to the display panel. The plurality of data voltages includes a first data voltage applied to a first area of the display panel, a second data voltage applied to a second area of the display panel, and a third data voltage applied to a third area of the display panel. The first area is closer to a timing controller than the second area, and the second area is closer to the timing controller than the third area. A first slew rate of the first data voltage is set to be smaller than a second slew rate of the second data voltage, and the second slew rate of the second data voltage is set to be smaller than a third slew rate of the third data voltage. The method further includes outputting the first data voltage having the first slew rate, the second data voltage having the second slew rate, and the third data voltage having the third slew rate to the display panel, and displaying a plurality of grayscales on the display panel in response to the plurality of gate signals, the first data voltage having the first slew rate, the second data voltage having the second slew rate, and the third data voltage having the third slew rate.

According to a method of driving a display panel and a display apparatus for performing the method according to exemplary embodiments, the slew rate of the data voltage output from the data driver may be adjusted to compensate for the difference of the charging rates between the pixels due to a propagation delay of the data line or the difference of the charging rates between the pixels due to a propagation delay of the gate line. In addition, the slew rate of the gate clock signal may be adjusted to compensate for the difference of the waveforms of the gate signals due to a propagation delay of the clock line. Thus, the display quality of the display panel may be improved.

BRIEF DESCRIPTION OF THE DRAWINGS

The above and other features of the present inventive concept will become more apparent by describing in detail exemplary embodiments thereof with reference to the accompanying drawings, in which.

DETAILED DESCRIPTION OF THE EXEMPLARY EMBODIMENTS

Figure 1:
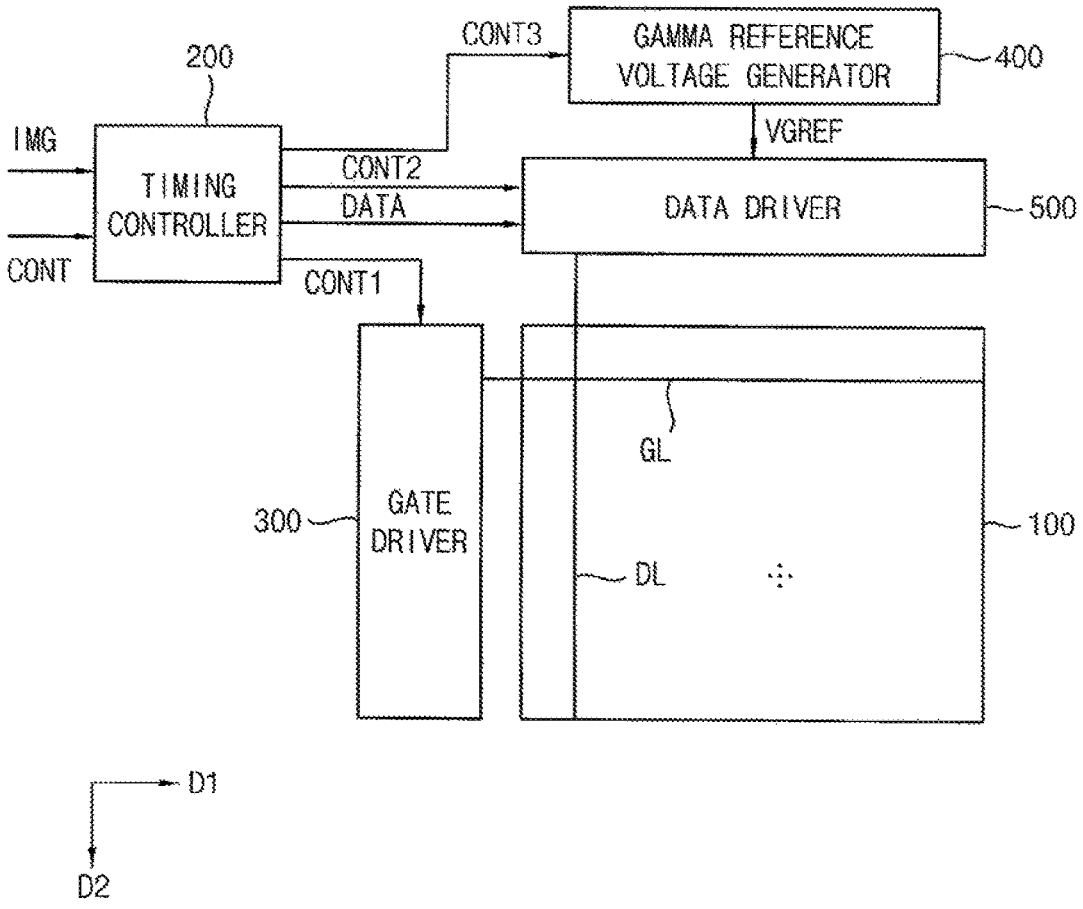
FIG. 1 is a block diagram illustrating a display apparatus according to an exemplary embodiment of the present inventive concept.

Exemplary embodiments of the present inventive concept will be described more fully hereinafter with reference to the accompanying drawings. Like reference numerals may refer to like elements throughout the accompanying drawings.

As used herein, the singular forms "a", "an" and "the" are intended to include the plural forms as well, unless the context clearly indicates otherwise. Further, when two or more elements or values are described as being substantially the same as or about equal to each other, it is to be understood that the elements or values are identical to each other, indistinguishable from each other, or distinguishable from each other but functionally the same as each other as would be understood by a person having ordinary skill in the art.

FIG. 1 is a block diagram illustrating a display apparatus according to an exemplary embodiment of the present inventive concept.

Referring to FIG. 1, the display apparatus includes a display panel 100 and a display panel driver. The display panel driver includes a timing controller 200, a gate driver 300, a gamma reference voltage generator 400, and a data driver 500.

The display panel 100 has a display region on which an image is displayed and a peripheral region adjacent to the display region.

The display panel 100 includes a plurality of gate lines GL, a plurality of data lines DL, and a plurality of pixels connected to the gate lines GL and the data lines DL. The gate lines GL extend in a first direction D1 and the data lines DL extend in a second direction D2 crossing the first direction D1.

Each pixel includes a switching element, a liquid crystal capacitor, and a storage capacitor. The liquid crystal capacitor and the storage capacitor are electrically connected to the switching element. The pixels may be disposed in a matrix form.

The timing controller 200 receives input image data IMG and an input control signal CONT from an external apparatus. The input image data may include, for example, red image data, green image data, and blue image data. The input control signal CONT may include, for example, a master clock signal and a data enable signal. The input control signal CONT may further include, for example, a vertical synchronization signal and a horizontal synchronization signal.

The timing controller 200 generates a first control signal CONT1, a second control signal CONT2, a third control signal CONT3, and a data signal DATA based on the input image data IMG and the input control signal CONT.

The first control signal CONT1 controls an operation of the gate driver 300 based on the input control signal CONT. The timing controller 200 outputs the first control signal CONT1 to the gate driver 300. The first control signal CONT1 may include, for example, a vertical start signal and a gate clock signal.

The second control signal CONT2 controls an operation of the data driver 500 based on the input control signal CONT. The timing controller 200 outputs the second control signal CONT2 to the data driver 500. The second control signal CONT2 may include, for example, a horizontal start signal and a load signal.

The timing controller 200 generates the data signal DATA based on the input image data IMG. The timing controller 200 outputs the data signal DATA to the data driver 500.

The third control signal CONT3 controls an operation of the gamma reference voltage generator 400 based on the input control signal CONT. The timing controller 200 outputs the third control signal CONT3 to the gamma reference voltage generator 400.

The gate driver 300 generates gate signals that drive the gate lines GL in response to the first control signal CONT1 received from the timing controller 200. The gate driver 300 sequentially outputs the gate signals to the gate lines GL.

The gamma reference voltage generator 400 generates a gamma reference voltage VGREF in response to the third control signal CONT3 received from the timing controller 200. The gamma reference voltage generator 400 provides the gamma reference voltage VGREF to the data driver 500. The gamma reference voltage VGREF has a value corresponding to a level of the data signal DATA.

In exemplary embodiments, the gamma reference voltage generator 400 may be disposed separate from the timing controller 200 and the data driver 500, in the timing controller 200, or in the data driver 500.

The data driver 500 receives the second control signal CONT2 and the data signal DATA from the timing controller 200, and receives the gamma reference voltage VGREF from the gamma reference voltage generator 400. The data driver 500 converts the data signal DATA into analog data voltages using the gamma reference voltage VGREF. The data driver 500 outputs the data voltages to the data lines DL.

Figure 2:
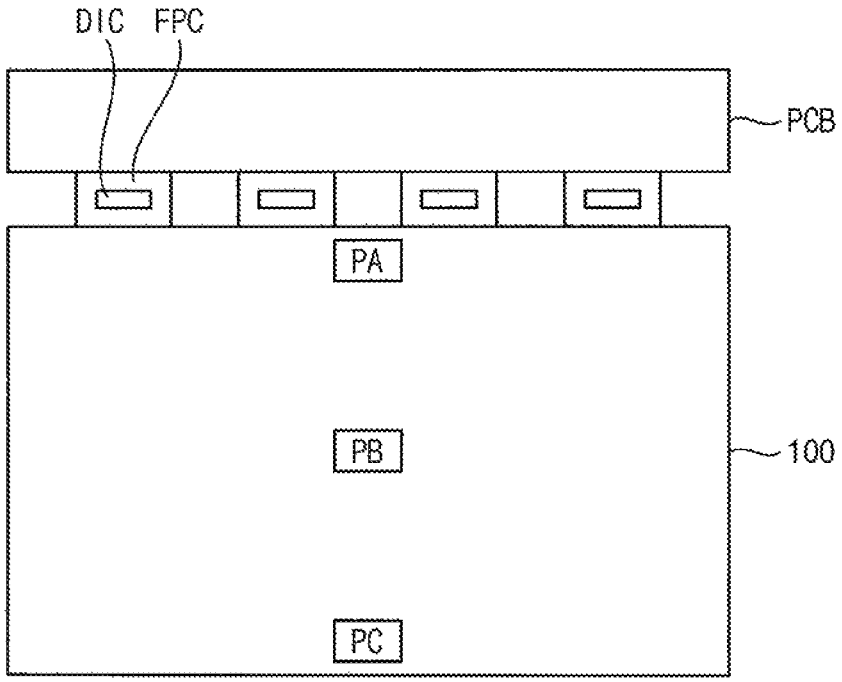
FIG. 2 is a conceptual diagram illustrating a display panel of FIG. 1 for describing waveforms of data voltages according to positions of pixels in the display panel according to an exemplary embodiment of the present inventive concept.
Figure 3:
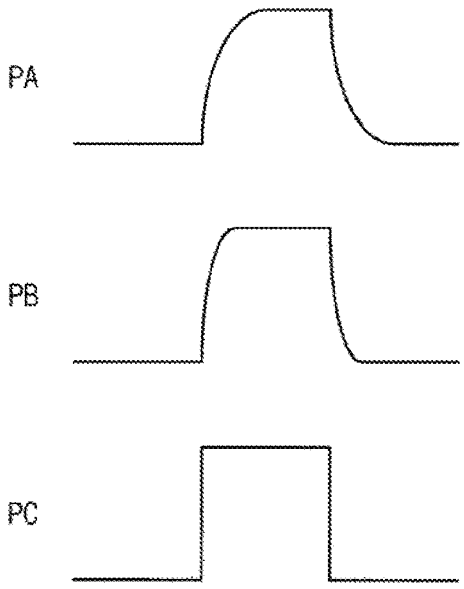
FIG. 3 is a waveform diagram illustrating data voltages output to the pixels in a first area, a second area, and a third area of FIG. 2 according to an exemplary embodiment of the present inventive concept.
Figure 4:
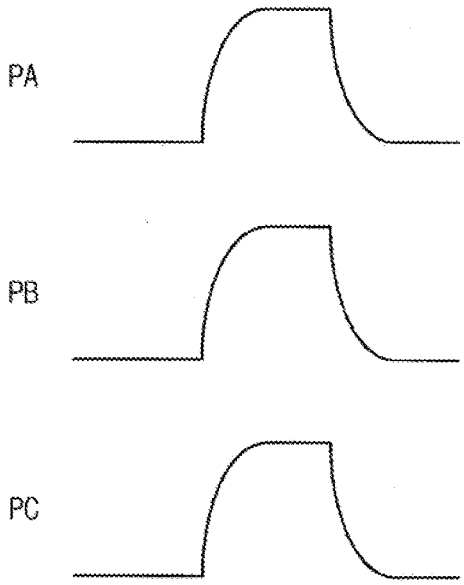
FIG. 4 is a waveform diagram illustrating the data voltages received at the pixels in the first area, the second area, and the third area of FIG. 2 when the data voltages of FIG. 3 are output to the pixels according to an exemplary embodiment of the present inventive concept.

FIG. 2 is a conceptual diagram illustrating a display panel of FIG. 1 for describing waveforms of data voltages according to positions of pixels in the display panel according to an exemplary embodiment of the inventive concept. FIG. 3 is a waveform diagram illustrating data voltages output to the pixels in a first area, a second area, and a third area of FIG. 2 according to an exemplary embodiment of the inventive concept. FIG. 4 is a waveform diagram illustrating the data voltages received at the pixels in the first area, the second area, and the third area of FIG. 2 when the data voltages of FIG. 3 are output to the pixels according to an exemplary embodiment of the inventive concept.

Referring to FIGS. 1 to 4, the data driver 500 may include a data driving chip DIC, and a flexible printed circuit FPC connecting the data driving chip DIC to a printed circuit board PCB. The data driver 500 may include, for example, a plurality of the data driving chips DIC. The timing controller 200 may be disposed in the printed circuit board PCB.

The data voltage is output to the display panel 100 through the data line DL extending from the data driver 500 to the display panel 100. The data voltage may be delayed in propagation due to the resistance of the data line DL.

In FIG. 2, the display panel 100 includes a first area PA, a second area PB, and a third area PC. From among the first area PA, the second area PB, and the third area PC, a distance from the data driver 500 to the first area PA is the shortest, a distance from the data driver 500 to the second area PB is longer than the distance from the data driver 500 to the first area PA, and a distance from the data driver 500 to the third area PC is longer than the distance from the data driver 500 to the second area PB. Thus, the distance from the data driver 500 to the third area PC is the longest from among the first area PA, the second area PB, and the third area PC.

When the same data voltage is applied to the first area PA, the second area PB, and the third area PC, a propagation delay of the data voltage received at a pixel in the third area PC is the highest from among pixels in the first area PA, the second area PB, and the third area PC. A propagation delay of the data voltage received at the pixel in the second area PB is less than the propagation delay of the data voltage received at the pixel in the third area PC. A propagation delay of the data voltage received at the pixel in the first area PA is the lowest from among the pixels in the first area PA, the second area PB, and the third area PC.

When the same data voltage is applied to the first area PA, the second area PB, and the third area PC, a charging rate of the pixel in the third area PC is the lowest from among the pixels in the first area PA, the second area PB, and the third area PC. A charging rate of the pixel in the second area PB is higher than the charging rate of the pixel in the third area PC. A charging rate of the pixel in the first area PA is the highest from among the pixels in the first area PA, the second area PB, and the third area PC.

A display artifact may be generated on the display panel 100 due to the difference of the charging rates of the pixels according to positions of the pixels in the display panel 100. For example, a luminance of a lower portion (e.g., the third area PC) of the display panel 100 which is relatively far from the data driver 500 may be lower than a luminance of an upper portion (e.g., the first area PA) of the display panel 100 which is relatively close to the data driver 500 with respect to the same grayscale. Herein, the term grayscale may refer to the grayscale values corresponding to each of the colors included in the input image data IMG (e.g., a red image data grayscale value, a green image data grayscale value, and a blue image data grayscale value). According to exemplary embodiments of the inventive concept, the grayscale values may be displayed in response to gate signals and data voltages having varied slew rates, as described further below. For example, grayscale values may be adjusted by varying slew rates of data voltages according to a position in the display panel 100 at which the data voltages are to be applied. Thus, pixels at different positions in the display panel 100 may have different grayscale values based on the slew rates of the corresponding data voltages.

According to exemplary embodiments of the inventive concept, to compensate the difference of the charging rates of the pixels according to positions of the pixels in the display panel 100, the data driver 500 may output the data voltages having slew rates varied according to the positions in the display panel 100. According to exemplary embodiments, the slew rate refers to a voltage change in a predetermined time duration. For example, the slew rate may be defined as the change of voltage per unit of time in a predetermined time duration. When the slew rate is relatively great, the voltage change is relatively great in the predetermined time duration. When the slew rate is relatively small, the voltage change is relatively small in the predetermined time duration. When the slew rate is relatively great, rising and falling of the waveform of the signal is relatively fast. When the slew rate is relatively small, the rising and the falling of the waveform of the signal is relatively slow. This relationship is described further below with reference to FIG. 3.

The slew rate of the data voltage may be set and varied, for example, by the timing controller 200. The timing controller 200 may output the data signal DATA and slew rate information according to the position in the display panel 100 to the data driver 500. The data driver 500 may generate the data voltage, of which the slew rate is adjusted based on the data signal DATA and the slew rate information received from the timing controller 200. That is, the timing controller 200 may adjust the slew rate of the data voltage, and the data driver 500 may output the data voltage having the adjusted slew rate to the display panel 100.

FIG. 3 represents the waveform of the data voltages output to the pixels of the first area PA, the second area PB, and the third area PC according to an exemplary embodiment of the inventive concept. As shown in FIG. 3, as the distance of the pixel from the data driver 500 increases, the slew rate of the data voltage may increase. The slew rate of the data voltage output to the pixel of the first area PA is the least from among the pixels of the first area PA, the second area PB, and the third area PC. The slew rate of the data voltage output to the pixel of the second area PB is greater than the slew rate of the data voltage output to the pixel of the first area PA. The slew rate of the data voltage output to the pixel of the third area PC is the greatest from among the pixels of the first area PA, the second area PB, and the third area PC.

FIG. 4 represents the waveform of the data voltages received at the pixels of the first area PA, the second area PB, and the third area PC according to an exemplary embodiment of the inventive concept. As shown in FIG. 4, due to the adjustment of the slew rate of the data voltage as described with reference to FIG. 3, the data voltages received at the pixels of the first area PA, the second area PB, and the third area PC may have substantially the same waveform as one another regardless of the distance from the data driver 500. As a result, the difference of the charging rates of the pixels according to positions of the pixels in the display panel 100 may be compensated. Thus, the display quality of the display panel 100 may be improved.

Figure 5:
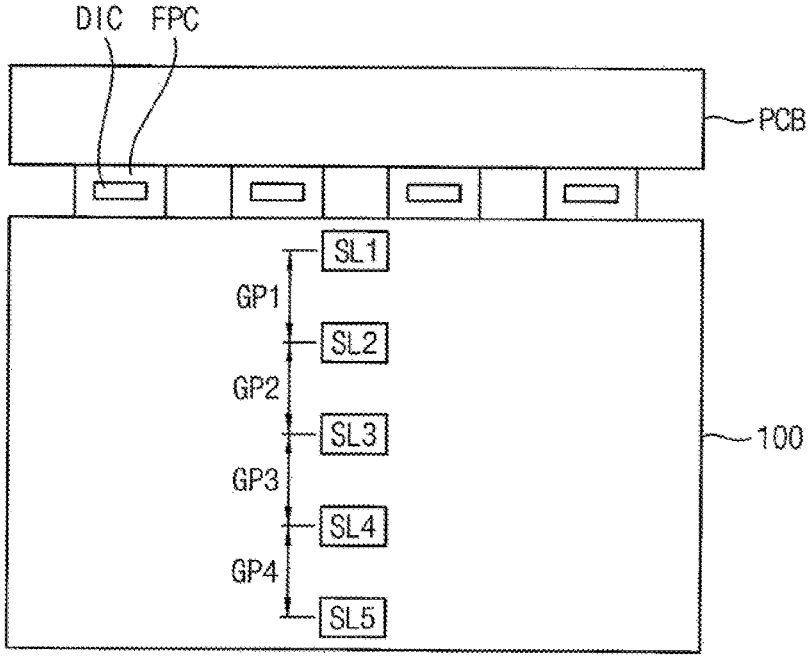
FIG. 5 is a conceptual diagram illustrating the display panel of FIG. 1 for describing an exemplary method of setting slew rates of the data voltages output to the display panel according to an exemplary embodiment of the present inventive concept.

FIG. 5 is a conceptual diagram illustrating the display panel of FIG. 1 for describing an exemplary method of setting slew rates of the data voltages output to the display panel according to an exemplary embodiment of the inventive concept.

Referring to FIGS. 1 to 5, as the distance of the pixel from the data driver 500 increases, the slew rate of the data voltage may gradually increase.

For example, as the distance of the pixel from the data driver 500 increases, the slew rate of the data voltage may linearly increase (e.g., increase in a uniform manner). For example, the slew rate of the data voltage may increase by the same amount between each of a plurality of slew rate adjustment points set in the display panel 100, as described below. When the width of the data line DL is uniform, the resistance of the data line DL may linearly increase as the distance from the data driver 500 increases. Accordingly, in an exemplary embodiment, the slew rate of the data voltage may be set to linearly increase.

A plurality of slew rate adjustment points may be set in the display panel 100 to increase the slew rate of the data voltage. For example, in the exemplary embodiment of FIG. 5, five slew rate adjustment points SL1, SL2, SL3, SL4 and SL5 may be set in the display panel 100. Although the exemplary embodiment of FIG. 5 includes five slew rate adjustment points, the inventive concept is not limited thereto. For example, in exemplary embodiments, six or more slew rate adjustment points may be set in the display panel 100, or four or less slew rate adjustment points may be set in the display panel 100.

The distances between the five slew rate adjustment points SL1, SL2, SL3, SL4 and SL5 may be uniform. For example, a first distance GP1 between a first slew rate adjustment point SL1 and a second slew rate adjustment point SL2, a second distance GP2 between the second slew rate adjustment point SL2 and a third slew rate adjustment point SL3, a third distance GP3 between the third slew rate adjustment point SL3 and a fourth slew rate adjustment point SL4, and a fourth distance GP4 between the fourth slew rate adjustment point SL4 and a fifth slew rate adjustment point SL5 may be substantially the same as one another.

The timing controller 200 may set the respective slew rates of the five slew rate adjustment points SL1, SL2, SL3, SL4 and SL5. In an exemplary embodiment, the slew rate adjustment points SL1, SL2, SL3, SL4 and SL5 may be coordinates of the pixels in the display panel 100. The slew rate of the first slew rate adjustment point SL1, the slew rate of the second slew rate adjustment point SL2, the slew rate of the third slew rate adjustment point SL3, the slew rate of the fourth slew rate adjustment point SL4, and the slew rate of the fifth slew rate adjustment point SL5 may linearly increase (e.g., the slew rates may increase in a uniform manner). Thus, as described with reference to FIG. 5, according to an exemplary embodiment of the inventive concept, the change of the increase of the slew rate of the data voltage in a predetermined distance may be uniform regardless of the distance from the data driver 500.

In exemplary embodiments, the slew rates of the areas between the slew rate adjustment points SL1, SL2, SL3, SL4 and SL5 may be set by interpolation of the slew rates of the slew rate adjustment points SL1, SL2, SL3, SL4 and SL5.

Figure 6:
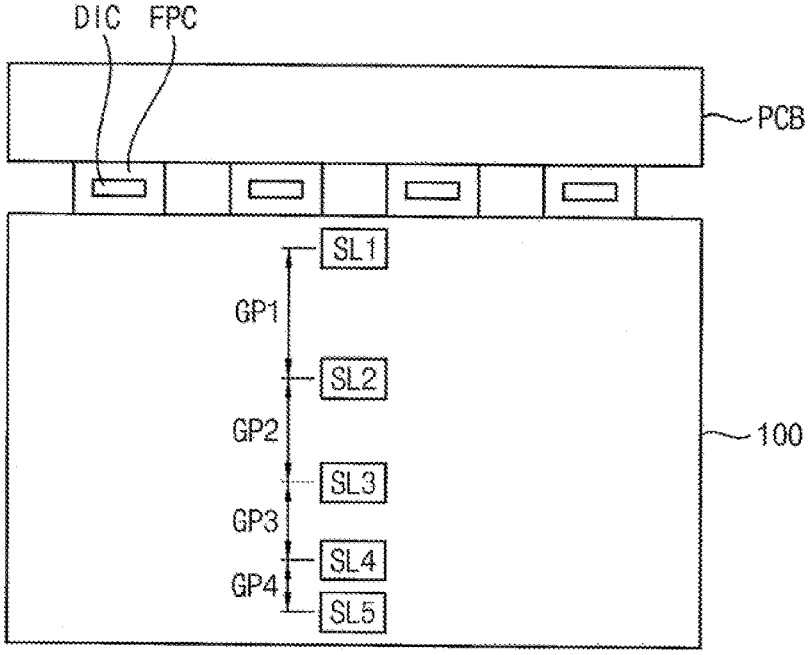
FIG. 6 is a conceptual diagram illustrating the display panel of FIG. 1 for describing an exemplary method of setting the slew rates of the data voltages output to the display panel according to an exemplary embodiment of the present inventive concept.

FIG. 6 is a conceptual diagram illustrating the display panel of FIG. 1 for describing an exemplary method of setting the slew rates of the data voltages output to the display panel according to an exemplary embodiment of the inventive concept.

Referring to FIGS. 1 to 4 and 6, as the distance of the pixel from the data driver 500 increases, the slew rate of the data voltage may gradually increase.

For example, as the distance of the pixel from the data driver 500 increases, the slew rate of the data voltage may nonlinearly increase (e.g., increase in a non-uniform manner). As described above with reference to FIG. 5, when the width of the data line DL is uniform, the resistance of the data line DL may linearly increase as the distance from the data driver 500 increases. However, the charging rate of the data voltage which is charged to the pixels may nonlinearly decrease due to, for example, the characteristics of the switching elements of the pixels and the characteristics of the liquid crystal layer. Accordingly, in an exemplary embodiment, the slew rate of the data voltage may be set (e.g., by the timing controller 200) to nonlinearly increase.

Referring to FIG. 6, a plurality of slew rate adjustment points may be set in the display panel 100 to increase the slew rate of the data voltage. For example, the five slew rate adjustment points SL1, SL2, SL3, SL4 and SL5 may be set in the display panel 100. Although the exemplary embodiment of FIG. 6 includes five slew rate adjustment points, the inventive concept is not limited thereto. For example, in exemplary embodiments, six or more slew rate adjustment points may be set in the display panel 100, or four or less slew rate adjustment points may be set in the display panel 100.

Unlike the exemplary embodiment of FIG. 5, the distances between the five slew rate adjustment points SL1, SL2, SL3, SL4 and SL5 may not be uniform. For example, a first distance GP1 between a first slew rate adjustment point SL1 and a second slew rate adjustment point SL2 may be greater than a second distance GP2 between the second slew rate adjustment point SL2 and a third slew rate adjustment point SL3. The second distance GP2 between the second slew rate adjustment point SL2 and a third slew rate adjustment point SL3 may be greater than a third distance GP3 between the third slew rate adjustment point SL3 and a fourth slew rate adjustment point SL4. The third distance GP3 between the third slew rate adjustment point SL3 and a fourth slew rate adjustment point SL4 may be greater than a fourth distance GP4 between the fourth slew rate adjustment point SL4 and a fifth slew rate adjustment point SL5.

The timing controller 200 may set the respective slew rates of the five slew rate adjustment points SL1, SL2, SL3, SL4 and SL5. In an exemplary embodiment, the slew rate adjustment points SL1, SL2, SL3, SL4 and SL5 may be coordinates of the pixels in the display panel 100.

In the exemplary embodiment of FIG. 6, the slew rate of the first slew rate adjustment point SL1, the slew rate of the second slew rate adjustment point SL2, the slew rate of the third slew rate adjustment point SL3, the slew rate of the fourth slew rate adjustment point SL4, and the slew rate of the fifth slew rate adjustment point SL5 may increase (e.g., in an nonlinear manner). Thus, the change of the increase of the slew rate of the data voltage in a predetermined distance may increase as the distance from the data driver 500 increases.

In an exemplary embodiment, the slew rates of the areas between the slew rate adjustment points SL1, SL2, SL3, SL4 and SL5 may be set by interpolation of the slew rates of the slew rate adjustment points SL1, SL2, SL3, SL4 and SL5.

As described with reference to FIG. 6, according to an exemplary embodiment of the inventive concept, the slew rate of the data voltage output from the data driver 500 may be adjusted to compensate for the propagation delay of the data voltage due to the resistance of the data line DL. Thus, the display quality of the display panel 100 may be improved.

Figure 7:
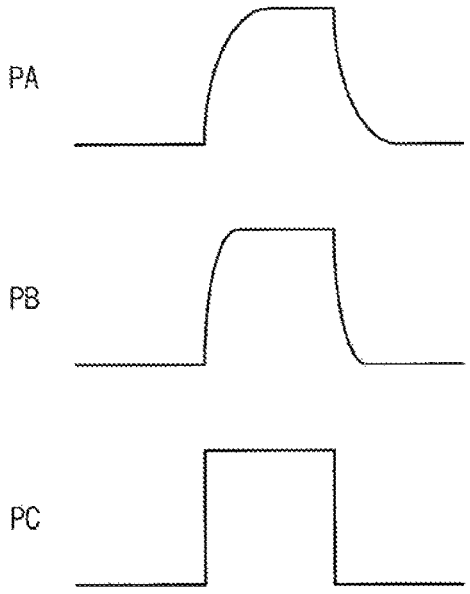
FIG. 7 is a waveform diagram illustrating data voltages output to pixels in a first area, a second area, and a third area of a display panel according to an exemplary embodiment of the present inventive concept.
Figure 8:
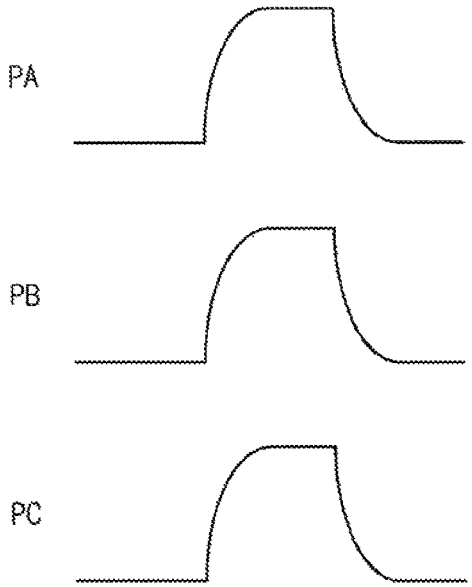
FIG. 8 is a waveform diagram illustrating data voltages received at the pixels in the first area, the second area, and the third area when the data voltages of FIG. 7 are output to the pixels according to an exemplary embodiment of the present inventive concept.
Figure 9:
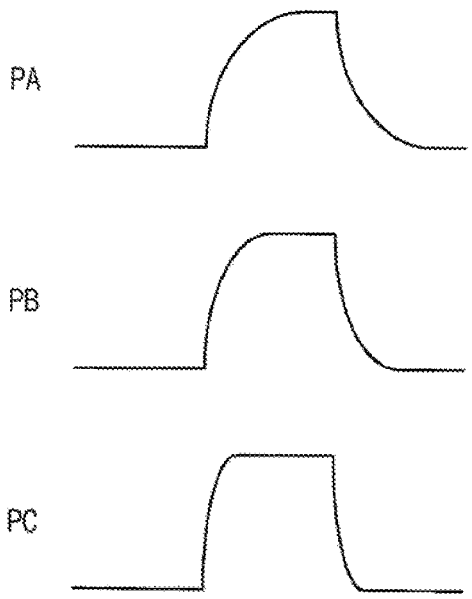
FIG. 9 is a waveform diagram illustrating data voltages output to pixels in a first area, a second area, and a third area of the display panel described with reference to FIG. 7 according to an image pattern displayed on the display panel according to an exemplary embodiment of the present inventive concept.
Figure 10:
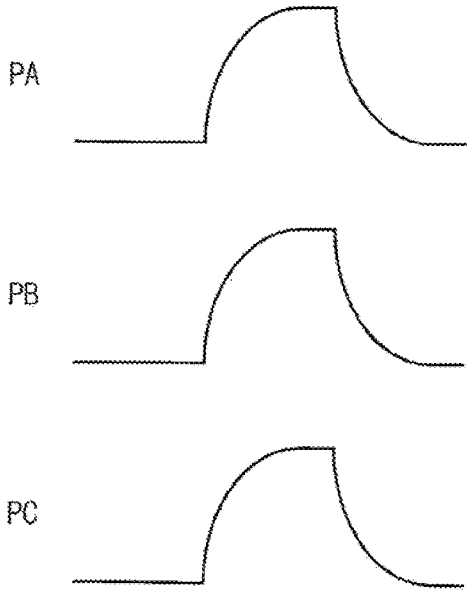
FIG. 10 is a waveform diagram illustrating the data voltages received at the pixels in the first area, the second area, and the third area when the data voltages of FIG. 9 are output to the pixels according to an exemplary embodiment of the present inventive concept.

FIG. 7 is a waveform diagram illustrating data voltages output to pixels in a first area, a second area, and a third area of a display panel according to an exemplary embodiment of the present inventive concept. FIG. 8 is a waveform diagram illustrating data voltages received at the pixels in the first area, the second area, and the third area when the data voltages of FIG. 7 are output to the pixels according to an exemplary embodiment of the inventive concept. FIG. 9 is a waveform diagram illustrating data voltages output to pixels in a first area, a second area, and a third area of the display panel described with reference to FIG. 7 according to an image pattern displayed on the display panel according to an exemplary embodiment of the inventive concept. FIG. 10 is a waveform diagram illustrating the data voltages received at the pixels in the first area, the second area, and the third area when the data voltages of FIG. 9 are output to the pixels according to an exemplary embodiment of the inventive concept.

The method of driving the display panel and the display apparatus according to an exemplary embodiment of the inventive concept as described herein is substantially the same as the method of driving the display panel and the display apparatus of the exemplary embodiment described with reference to FIGS. 1 to 6, except that the slew rate of the data voltage is determined according to the position in the display panel as well as the image displayed on the display panel. Thus, for convenience of explanation, the same reference numerals may be used to refer to the same or like parts as those described above with reference to FIGS. 1 to 6, and any repetitive description concerning the above elements may be omitted herein.

The display panel 100 of an exemplary embodiment described with reference to FIG. 7 displays an image pattern that does not generate heat over a threshold at the data driver 500. In contrast, the display panel 100 of an exemplary embodiment described with reference to FIG. 9 displays an image pattern that generates heat over the threshold at the data driver 500.

Referring to FIGS. 7 and 8, as the distance of the pixel from the data driver 500 increases, the slew rate of the data voltage may increase.

As shown in FIG. 8, due to the adjustment of the slew rate of the data voltage as described with reference to FIG. 3, the data voltages received at the pixels of the first area PA, the second area PB, and the third area PC may have substantially the same waveform as one another regardless of the distance from the data driver 500. As a result, the difference of the charging rates of the pixels according to positions of the pixels in the display panel 100 may be compensated for. Thus, the display quality of the display panel 100 may be improved.

Referring to FIGS. 9 and 10, as the distance of the pixel from the data driver 500 increases, the slew rate of the data voltage may increase.

As shown in FIG. 10, due to the adjustment of the slew rate of the data voltage as described with reference to FIG. 3, the data voltages received at the pixels of the first area PA, the second area PB, and the third area PC may have substantially the same waveform as one another regardless of the distance from the data driver 500. As a result, the difference of the charging rates of the pixels according to positions of the pixels in the display panel 100 may be compensated. Thus, the display quality of the display panel 100 may be improved.

Referring to FIGS. 7 and 9, the slew rate of the data voltage in the first area PA in FIG. 9 may be less than the slew rate of the data voltage in the first area PA in FIG. 7. The slew rate of the data voltage in the second area PB in FIG. 9 may be less than the slew rate of the data voltage in the second area PB in FIG. 7. The slew rate of the data voltage in the third area PC in FIG. 9 may be less than the slew rate of the data voltage in the third area PC in FIG. 7.

In FIG. 9, the display panel 100 displays the image pattern that generates heat over the threshold at the data driver 500 so that the slew rate of the data voltage in FIG. 9 may be less than the slew rate of the data voltage in FIG. 7. When the display panel 100 displays the image pattern that generates heat over the threshold at the data driver 500, the data driver 500 may be damaged or the power consumption of the data driver 500 may increase. Thus, when the display panel 100 displays the image pattern that generates heat over the threshold at the data driver 500, the slew rate of the data voltage may be relatively small.

In the exemplary embodiment described with reference to FIG. 9, the slew rate of the data voltage may be determined according to the position in the display panel 100 as well as the image pattern displayed on the display panel 100. For example, when a data voltage applied to a single data line repetitively increases and decreases according to the image pattern displayed on the display panel 100 the slew rate of the data voltage may be set to be decreased. For example, in an exemplary embodiment, the timing controller 200 may decrease the slew rate of the data voltage in response to the data voltage being applied to a single data line, and in response to the data voltage being applied to the single data line repetitively increasing and decreasing according to the image pattern displayed on the display panel 100.

For example, the image pattern that generates heat over the threshold may be a pattern repetitively increasing and decreasing the data voltage applied to the single data line. The pattern repetitively increasing and decreasing the data voltage applied to the single data line may be, for example, a horizontal stripe pattern. When the data voltage applied to the single data line repetitively increase and decrease, the power consumption and the heat of the data driver may increase.

In contrast, for example, the image pattern that does not generate heat over the threshold may be a pattern maintaining the data voltage applied to the single data line at a uniform level. The pattern maintaining the data voltage applied to the single data line in a uniform level may be, for example, a single color pattern. When the data voltage applied to the single data line maintains a uniform level, the power consumption and the heat of the data driver may decrease.

As described above, the slew rate of the data voltage may be set by the timing controller 200. In exemplary embodiments, the timing controller 200 may set the slew rate of the data voltage according to the position in the display panel 100 as well as the image pattern displayed on the display panel 100. For example, in addition to setting the slew rate of the data voltage according to the position of pixels in the display panel 100, in exemplary embodiments, the slew rate of the data voltage may also be set according to the amount of beat generated due to the image pattern being displayed.

According to an exemplary embodiment of the inventive concept, the slew rate of the data voltage output from the data driver 500 may be adjusted to compensate for the propagation delay of the data voltage due to the resistance of the data line DL. Thus, the display quality of the display panel 100 may be improved.

Figure 11:
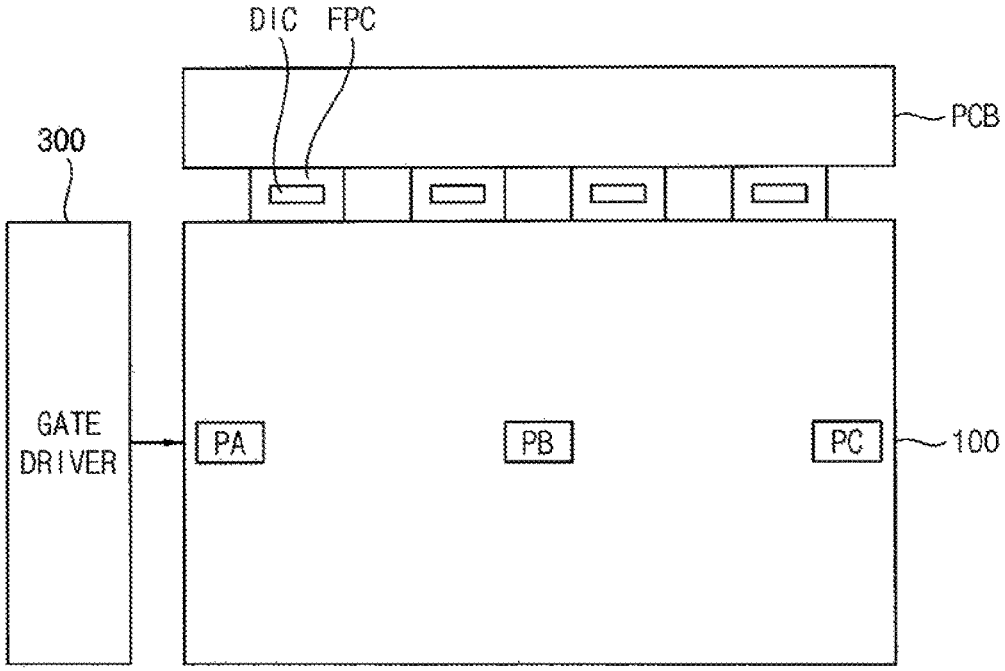
FIG. 11 is a conceptual diagram illustrating a display panel for describing waveforms of data voltages according to positions of pixels in the display panel according to an exemplary embodiment of the present inventive concept.
Figure 12:
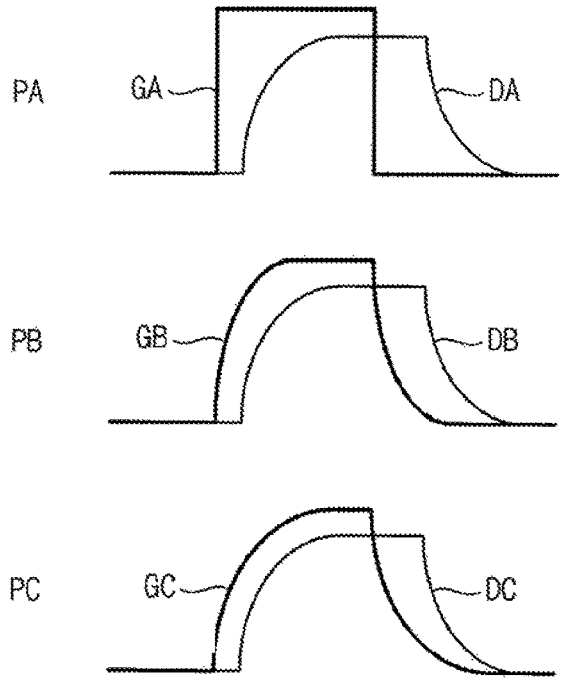
FIG. 12 is a waveform diagram illustrating gate signals and data voltages received at pixels in a first area, a second area, and a third area of FIG. 11 according to an exemplary embodiment of the present inventive concept.
Figure 13:
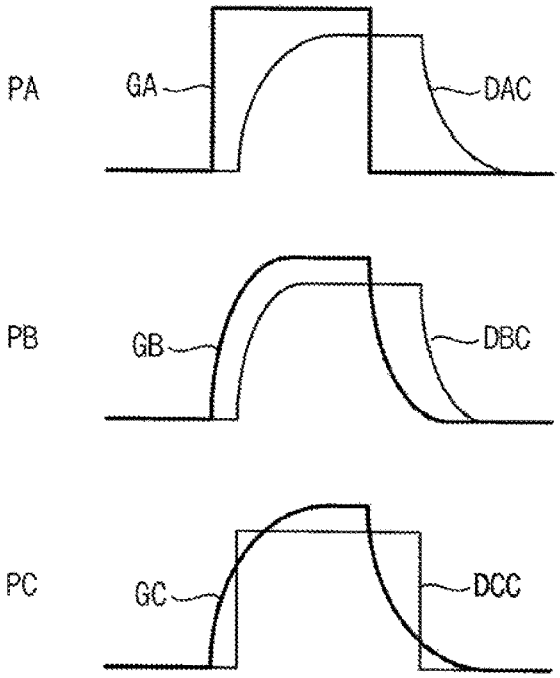
FIG. 13 is a waveform diagram illustrating gate signals received at the pixels in the first area, the second area, and the third area of FIG. 11, and data voltages output to the pixels in the first area, the second area, and the third area of FIG. 11 according to an exemplary embodiment of the present inventive concept.

FIG. 11 is a conceptual diagram illustrating a display panel for describing waveforms of data voltages according to positions of pixels in the display panel according to an exemplary embodiment of the present inventive concept. FIG. 12 is a waveform diagram illustrating gate signals and data voltages received at pixels in a first area, a second area, and a third area of FIG. 11 according to an exemplary embodiment of the inventive concept. FIG. 13 is a waveform diagram illustrating gate signals received at the pixels in the first area, the second area, and the third area of FIG. 11, and data voltages output to the pixels in the first area, the second area, and the third area of FIG. 11, according to an exemplary embodiment of the inventive concept.

The method of driving the display panel and the display apparatus according to an exemplary embodiment of the inventive concept as described herein is substantially the same as the method of driving the display panel and the display apparatus of the exemplary embodiment described with reference to FIGS. 1 to 6, except that the slew rate of the data voltage is adjusted to compensate for the propagation delay of the gate signal. Thus, for convenience of explanation, the same reference numerals may be used to refer to the same or like parts as those described above with reference to FIGS. 1 to 6, and any repetitive description concerning the above elements may be omitted herein.

Referring to FIGS. 1 and 11 to 13, the gate signal is output to the display panel 100 through the gate line GL extending from the gate driver 300 to the display panel 100. The gate signal may be delayed in propagation due to the resistance of the gate line GL.

In FIG. 11, from among a first area PA, a second area PB, and a third area PC, a distance from the gate driver 300 to the first area PA is the shortest. A distance from the gate driver 300 to the second area PB is longer than the distance from the gate driver 300 to the first area PA. A distance from the gate driver 300 to the third area PC is the longest from among the first area PA, the second area PB, and the third area PC.

The first area PA, the second area PB, and the third area PC are disposed in a same pixel row. As a result, the same gate signal is applied to the first area PA, the second area PB, and the third area PC. A propagation delay of the gate signal GC received at the pixel in the third area PC is the highest from among the pixels in the first area PA, the second area PB, and the third area PC. A propagation delay of the gate signal GB received at the pixel in the second area PB is less than the propagation delay of the gate signal received at the pixel in the third area PC. A propagation delay of the gate signal GA received at the pixel in the first area PA is the lowest from among the pixels in the first area PA, the second area PB, and the third area PC.

When data voltages DA, DB and DC having the same voltage level are applied to the first area PA, the second area PB and the third area PC, a charging rate of the pixel in the third area PC is the lowest from among the pixels in the first area PA, the second area PB, and the third area PC due to the propagation delay of the gate signal. A charging rate of the pixel in the second area PB is higher than the charging rate of the pixel in the third area PC due to the propagation delay of the gate signal. A charging rate of the pixel in the first area PA is the highest from among the pixels in the first area PA, the second area PB, and the third area PC.

A display artifact may be generated on the display panel 100 due to the difference of the charging rates of the pixels according to positions of the pixels in the display panel 100. For example, a luminance of a first side portion (e.g., a right portion near the third area PC) of the display panel 100, which is relatively far from the gate driver 300, may be lower than a luminance of a second side portion (e.g. a left portion near the first area PA) of the display panel 100, which is relatively close to the gate driver 300, with respect to the same grayscale.

To compensate for the difference of the charging rates of the pixels according to positions of the pixels in the display panel 100, the data driver 500 may output the data voltages having slew rates varied according to the positions in the display panel 100.

FIG. 13 illustrates the waveform of the data voltages DAC, DBC and DCC output to the pixels of the first area PA, the second area PB, and the third area PC, respectively. As shown in FIG. 13, as the distance of the pixel from the gate driver 300 increases, the slew rate of the data voltage may increase. The slew rate of the data voltage output to the pixel of the first area PA is the lowest from among the pixels of the first area PA, the second area PB, and the third area PC. The slew rate of the data voltage output to the pixel of the second area PB is greater than the slew rate of the data voltage output to the pixel of the first area PA. The slew rate of the data voltage output to the pixel of the third area PC is the greatest from among the pixels of the first area PA, the second area PB, and the third area PC.

Although not illustrated in FIGS. 12 and 13, in exemplary embodiments, the waveforms of the data voltages received at the pixels of the first area PA, the second area PB, and the third area PC may be similar to the waveforms of the data voltages DAC, DBC, and DCC output to the pixels of the first area PA, the second area PB, and the third area PC. For example, the waveforms of the data voltages received at the pixels of the first area PA, the second area PB, and the third area PC may be delayed waveforms of the data voltages DAC, DBC, and DCC output to the pixels of the first area PA, the second area PB, and the third area PC due to the propagation delay of the data lines DL.

As shown in FIG. 13, the data voltage having the relatively great slew rate is applied to the pixels in the area (e.g. the third area PC) having the relatively great propagation delay of the gate signal. The data voltage having the relatively small slew rate is applied to the pixels in the area (e.g. the first area PA) having the relatively small propagation delay of the gate signal. As a result, the difference of the charging rates of the pixels according to positions of the pixels in the display panel 100 due to the resistance of the gate line GL may be compensated. Thus, the display quality of the display panel 100 may be improved.

According to an exemplary embodiment, the slew rate of the data voltage output from the data driver 500 may be adjusted to compensate for the propagation delay of the gate signal due to the resistance of the gate line GL. Thus, the display quality of the display panel 100 may be improved.

Figure 14:
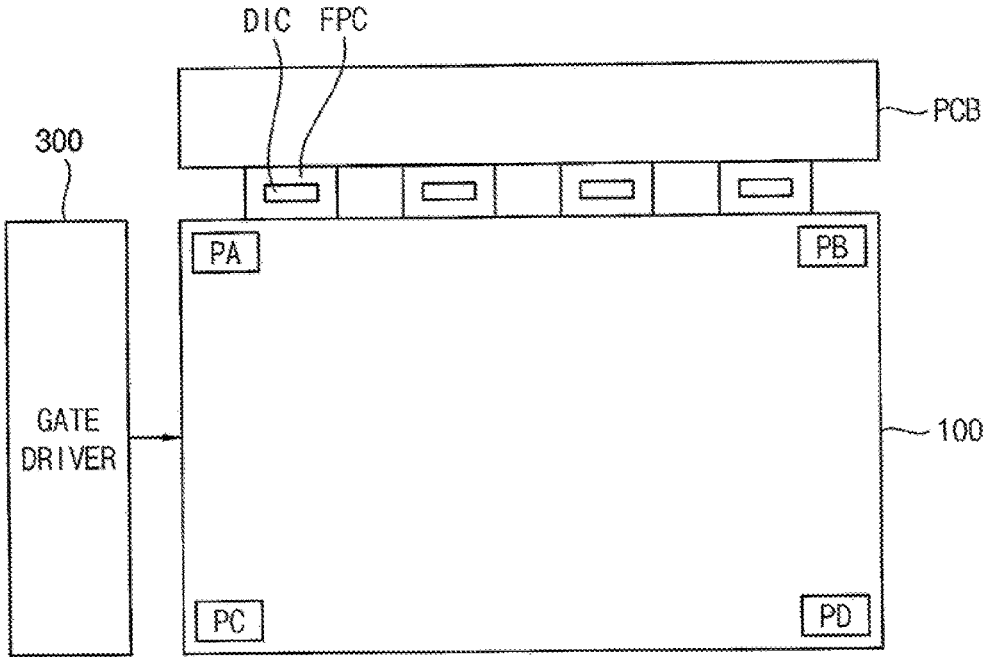
FIG. 14 is a conceptual diagram illustrating a display panel for describing waveforms of data voltages according to positions of pixels in the display panel according to an exemplary embodiment of the present inventive concept.
Figure 15:
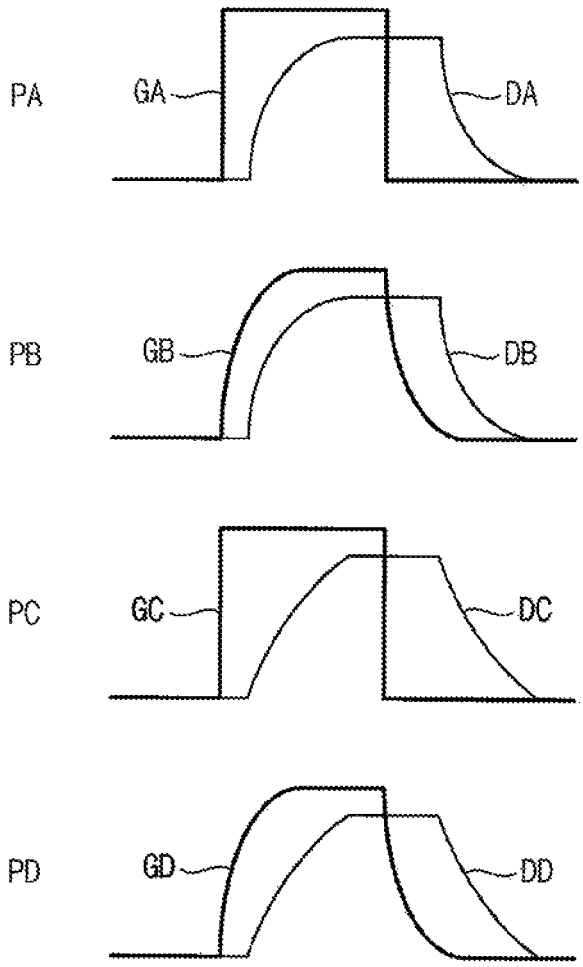
FIG. 15 is a waveform diagram illustrating gate signals and data voltages received at pixels in a first area, a second area, a third area, and a fourth area of FIG. 14 according to an exemplary embodiment of the present inventive concept.
Figure 16:
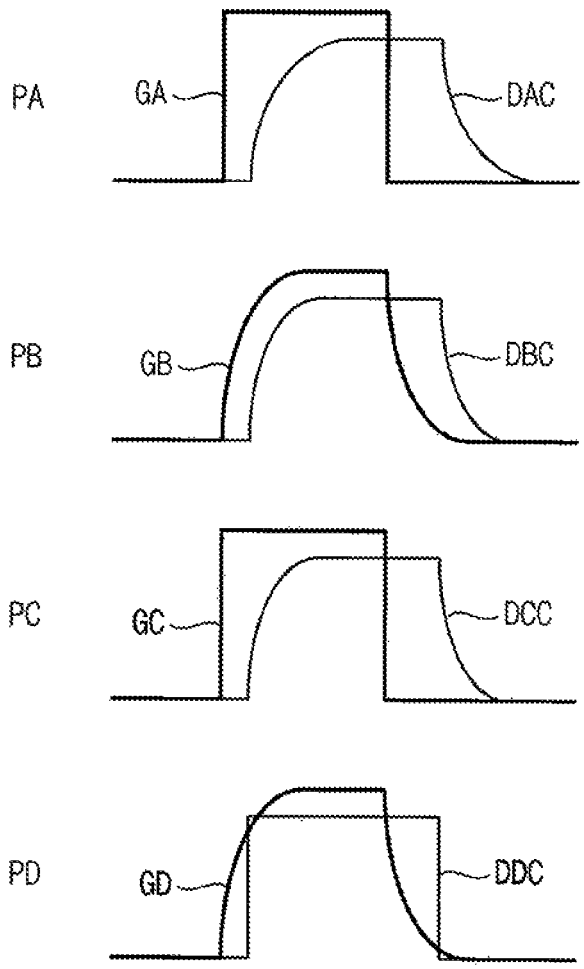
FIG. 16 is a waveform diagram illustrating gate signals received at the pixels in the first area, the second area, the third area, and the fourth area of FIG. 14, and data voltages output to the pixels in the first area, the second area, the third area, and the fourth area of FIG. 14 according to an exemplary embodiment of the present inventive concept.

FIG. 14 is a conceptual diagram illustrating a display panel for describing waveforms of data voltages according to positions of pixels in the display panel according to an exemplary embodiment of the present inventive concept. FIG. 15 is a waveform diagram illustrating gate signals and data voltages received at pixels in a first area, a second area, a third area, and a fourth area of FIG. 14 according to an exemplary embodiment of the inventive concept. FIG. 16 is a waveform diagram illustrating gate signals received at the pixels in the first area, the second area, the third area, and the fourth area of FIG. 14, and data voltages output to the pixels in the first area, the second area, the third area, and the fourth area of FIG. 14, according to an exemplary embodiment of the inventive concept.

The method of driving the display panel and the display apparatus according to an exemplary embodiment of the inventive concept as described herein is substantially the same as the method of driving the display panel and the display apparatus of the exemplary embodiment described with reference to FIGS. 1 to 6, except that the slew rate of the data voltage is adjusted to compensate both the propagation delay of the data voltage and the propagation delay of the gate signal. Thus, for convenience of explanation, the same reference numerals may be used to refer to the same or like parts as those described above with reference to FIGS. 1 to 6, and any repetitive description concerning the above elements may be omitted herein.

Referring to FIGS. 1 and 14 to 16, the gate signal is output to the display panel 100 through the gate line GL extending from the gate driver 300 to the display panel 100. The gate signal may be delayed in propagation due to the resistance of the gate line GL.

In FIG. 14, from among a first area PA and a third area PC, a distance from the data driver 500 to the first area PA is shorter than a distance from the data driver 500 to the third area PC.

When the same data voltage is applied to the first area PA and the third area PC, a propagation delay of the data voltage DC (see FIG. 15) received at the pixel in the third area PC is higher than a propagation delay of the data voltage DA (see FIG. 15) received at the pixel in the first area PA.

In FIG. 14, front among the first area PA and a second area PB, a distance from the gate driver 300 to the first area PA is shorter titan a distance from the gate driver 300 to the second area PB.

The first area PA and the second area PB are disposed in a same pixel row. As a result, the same gate signal is applied to the first area PA and the second area PB. A propagation delay of the gate signal GB (see FIG. 15) received at the pixel in the second area PB is higher than a propagation delay of the gate signal GA (see FIG. 15) received at the pixel in the first area PA.

In FIG. 14, from among the first area PA and a fourth area PD, a distance from the gate driver 300 and the data driver 500 to the first area PA is shorter than a distance from the gate driver 300 and the data driver 500 to the fourth area PD.

When the same data voltage is applied to the first area PA and the fourth area PD, a propagation delay of the data voltage DD (see FIG. 15) received at the pixel in the fourth area PD is higher than a propagation delay of the data voltage DA (see FIG. 15) received at the pixel in the first area PA.

Further, a propagation delay of the gate signal GD (see FIG. 15) received at the pixel in the fourth area PD is higher than a propagation delay of the gate signal GA received at the pixel in the first area PA.

When data voltages DA, DB, DC and DD (see FIG. 15) having the same voltage level are applied to the first area PA, the second area PB, the third area PC, and the fourth area PD, a charging rate of the pixel in the fourth area PD is the lowest from among the pixels in the first area PA, the second area PB, the third area PC, and the fourth area PD due to the propagation delay of the gate signal and the propagation delay of the data signal. A charging rate of the pixel in the first area PA is the greatest from among the pixels in the first area PA, the second area PB, the third area PC, and the fourth area PD.

A display artifact may be generated on the display panel 100 due to the difference of the charging rates of the pixels according to positions of the pixels in the display panel 100.

To compensate the difference of the charging rates of the pixels according to positions of the pixels in the display panel 100, the data driver 500 may output the data voltages having slew rates varied according to the positions in the display panel 100.

FIG. 16 illustrates the waveform of the data voltages DAC, DBC, DCC and DDC output to the pixels of the first area PA, the second area PB, the third area, PC and the fourth area PD. As shown in FIG. 16, as the distance of the pixel from the data driver 500 increases, the slew rate of the data voltage may increase. In addition, as the distance of the pixel from the gate driver 300 increases, the slew rate of the data voltage may increase.

As shown in FIG. 16, the data voltage having a relatively great slew rate is applied to the pixels in the area (e.g. the fourth area PD) having a relatively great propagation delay of the gate signal and a relatively great propagation delay of the data voltage. The data voltage having a relatively small slew rate is applied to the pixels in the area (e.g. the first area PA) having a relatively little propagation delay of the gate signal and a relatively small propagation delay of the data voltage. As a result, the difference of the charging rates of the pixels according to positions of the pixels in the display panel 100 due to the resistance of the gate line GL and the resistance of the data line DL may be compensated. Thus, the display quality of the display panel 100 may be improved.

Referring to FIGS. 14 to 16, according to an exemplary embodiment of the inventive concept, the slew rate of the data voltage output from the data driver 500 may be adjusted to compensate for the propagation delay of the gate signal due to the resistance of the gate line GL and the propagation delay of the data voltage due to the resistance of the data line DL. Thus, the display quality of the display panel 100 may be improved.

Figure 17:
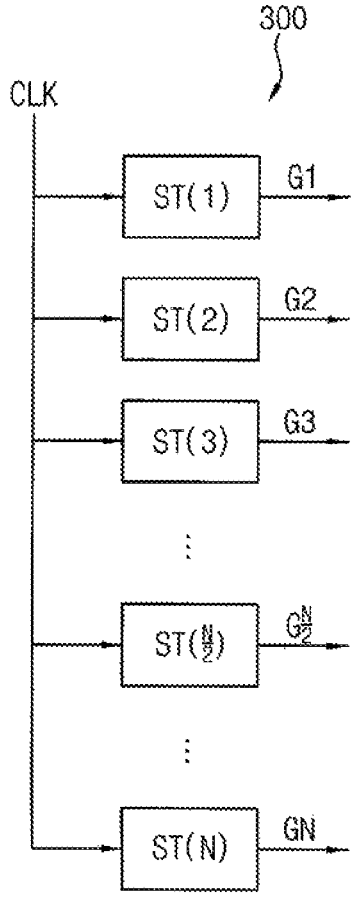
FIG. 17 is a conceptual diagram illustrating a gate driver for describing waveforms of gate clock signals according to positions in the gate driver according to an exemplary embodiment of the present inventive concept.
Figure 18:
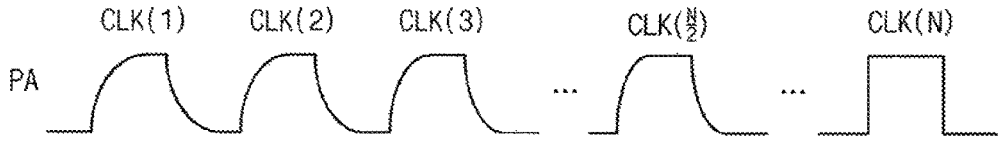
FIG. 18 is a waveform diagram illustrating the gate clock signals output to respective stages of FIG. 17 according to an exemplary embodiment of the present inventive concept.
Figure 19:
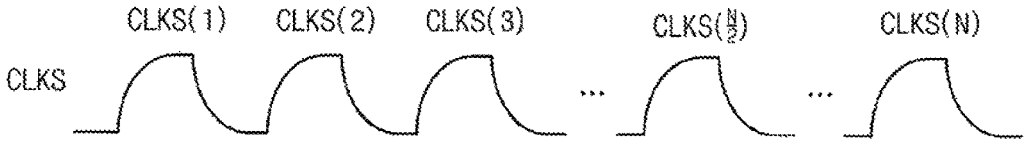
FIG. 19 is a waveform diagram illustrating the gate clock signals received at the respective stages of FIG. 17 when the gate clock signals of FIG. 17 are output to the respective stages according to an exemplary embodiment of the present inventive concept.

FIG. 17 is a conceptual diagram illustrating a gate driver for describing waveforms of gate clock signals according to positions in the gate driver according to an exemplary embodiment of the present inventive concept. FIG. 18 is a waveform diagram illustrating the gate clock signals output to respective stages of FIG. 17 according to an exemplary embodiment of the inventive concept. FIG. 19 is a waveform diagram illustrating the gate clock signals received at the respective stages of FIG. 17 when the gate clock signals of FIG. 17 are output to the respective stages according to an exemplary embodiment of the inventive concept.

The method of driving the display panel and the display apparatus according to an exemplary embodiment of the inventive concept as described herein is substantially the same as the method of driving the display panel and the display apparatus of the exemplary embodiment described with reference to FIGS. 1 to 6, except that the slew rate of the gate clock signal is adjusted to compensate for the propagation delay of the gate clock signal. Thus, for convenience of explanation, the same reference numerals may be used to refer to the same or like parts as those described above with reference to FIGS. 1 to 6, and any repetitive description concerning the above elements may be omitted herein.

Referring to FIGS. 1 and 17 to 19, the timing controller 200 outputs the gate clock signal CLK to the gate driver 300.

The gate driver 300 includes a plurality of stages ST(1) to ST(N), where N is an integer greater than or equal to 2. The stages are respectively connected to the gate lines GL, and respectively output gate signals G1 to GN to the display panel 100.

In FIG. 18, from among a first area ST(1), a second area ST(N/2), and a third area ST(N), a distance from the timing controller 200 to the first area ST(1) is the shortest. A distance from the timing controller 200 to the second area ST(N/2) is longer than the distance from the timing controller 200 to the first area ST(1). A distance from the timing controller 200 to the third area ST(N) is the longest from among the first area ST(1), the second area ST(N/2), and the third area ST(N).

When the same gate clock signal CLK is output to the first area ST(1), the second area ST(N/2), and the third area ST(N), a propagation delay of the gate clock signal CLK received at the stage in the third area ST(N) is the highest from among the stages in the first area ST(1), the second area ST(N/2), and the third area ST(N). A propagation delay of the gate clock signal CLK received at the stage in the second area ST(N/2) is less than the propagation delay of the gate clock signal CLK received at the stage in the third area ST(N). A propagation delay of the gate clock signal CLK received at the stage in the first area ST(1) is the lowest from among the stages in the first area ST(1), the second area ST(N/2), and the third area ST(N).

A difference of the waveforms of the gate signals G1 to GN output to the display panel 100 may be generated due to the difference of the propagation delay of the gate clock signal CLK. The difference of the charging rates of the pixels may be generated due to the difference of the waveforms of the gate signals G1 to GN.

FIG. 18 illustrates the waveform of the gate clock signal CLK output to the stages ST(1) to ST(N). As shown in FIG. 18, as the distance of the stage from the timing controller 200 increases, the slew rate of the gate clock signal CLK may increase. The slew rate of the gate clock signal CLK output to the stage of the first area ST(1) is the least from among the stages of the first area ST(1), the second area ST(N/2), and the third area ST(N). The slew rate of the gate clock signal CLK output to the stage of the third area ST(N) is the greatest from among the stages of the first area ST(1), the second area ST(N/2), and the third area ST(N). The gate signals G1 to GN are generated by the gate clock signal CLK so that the slew rate of the gate signals G1 to GN may be adjusted according to the position in the display panel 100. The slew rate of the gate signals G1 to GN may increase as the distance from the timing controller 200 increases. In exemplary embodiments, the slew rate of the gate signals G1 to GN may be set and varied (e.g., by the timing controller 200) according to the position in the display panel 100, and the slew rate of the data voltage output by the data driver is not adjusted.

FIG. 19 illustrates the waveform of the gate clock signal CLK received at the stages ST(1) to ST(N). As shown in FIG. 19, due to the adjustment of the slew rate of the gate clock signal CLK as described with reference to FIG. 18, the gate clock signal CLK received at the stages of the first area ST(1), the second area ST(N/2), and the third area ST(N) may have substantially the same waveform as one another regardless of the distance from the timing controller 200. As a result, the difference of the charging rates of the pixels according to positions of the pixels in the display panel 100 due to the resistance of the gate clock line may be compensated. Thus, the display quality of the display panel 100 may be improved.

According to the exemplary embodiments of the method of driving the display panel and the display apparatus described herein, the difference of the charging rates of the pixels due to the signal wirings may be compensated. As a result, the display quality of the display panel may be improved.

While the present inventive concept has been particularly shown and described with reference to the exemplary embodiments thereof, it will be understood by those of ordinary skill in the art that various changes in form and detail may be made therein without departing from the spirit and scope of the present inventive concept as defined by the following claims.

What is claimed is:

1. A method of driving a display panel, comprising:

outputting a gate signal to the display panel;

varying a slew rate of a data voltage to be output to the display panel according to a position in the display panel at which the data voltage is to be applied;

outputting the data voltage having the varied slew rate to the display panel; and displaying a grayscale on the display panel in response to the gate signal and the data voltage having the varied slew rate, wherein the slew rate of the data voltage nonlinearly increases as a distance from the data driver increases, and a change of the increase of the slew rate of the data voltage increases as the distance from the data driver increases.

2. The method of claim 1, wherein the slew rate of the data voltage is determined according to the position in the display panel and according to an image pattern displayed on the display panel.

3. The method of claim 2, further comprising:

decreasing the slew rate of the data voltage in response to the data voltage being applied to a single data line, and in response to the data voltage being applied to the single data line repetitively increasing and decreasing according to the image pattern displayed on the display panel.

4. The method of claim 1, wherein the slew rate of the data voltage increases as a distance from a gate driver increases.

5. The method of claim 1, wherein the slew rate of the data voltage increases as a distance from a data driver increases and as a distance from a gate driver increases.

6. The method of claim 1, wherein a gate driver comprises a plurality of stages, and the method further comprises:

varying a slew rate of a gate clock signal according to a position of the stages; and outputting the gate clock signal having the varied slew rate to the gate driver.

7. The method of claim 6, wherein a timing controller outputs the gate clock signal to the gate driver, and wherein the slew rate of the gate clock signal increases as a distance from the timing controller to the stages of the gate driver increases.

8. A display apparatus, comprising:

a display panel;

a timing controller configured to vary a slew rate of a data voltage to be output to the display panel according to a position in the display panel at which the data voltage is to be applied and according to an image pattern displayed on the display panel;

a gate driver configured to output a gate signal to the display panel; and a data driver configured to output the data voltage having the varied slew rate to the display panel, wherein the display panel is configured to display a grayscale in response to the gate signal and the data voltage having the varied slew rate, and wherein the timing controller is configured to decrease the slew rate of the data voltage in response to the data voltage being applied to a single data line, and in response to the data voltage being applied to the single data line repetitively increasing and decreasing according to the image pattern displayed on the display panel.

9. The display apparatus of claim 8, wherein the slew rate of the data voltage increases as a distance from the data driver increases.

10. The display apparatus of claim 9, wherein the slew rate of the data voltage linearly increases as the distance from the data driver increases.

11. The display apparatus of claim 9, wherein the slew rate of the data voltage nonlinearly increases as the distance from the data driver increases, and wherein a change of the increase of the slew rate of the data voltage increases as the distance from the data driver increases.

12. The display apparatus of claim 8, wherein the slew rate of the data voltage increases as a distance from the gate driver increases.

13. The display apparatus of claim 8, wherein the slew rate of the data voltage increases as a distance from the data driver increases and as a distance from the gate driver increases.

14. The display apparatus of claim 8, wherein the gate driver comprises a plurality of stages, and wherein the timing controller is further configured to vary a slew rate of a gate clock signal according to a position of the stages, and output the gate clock signal having the varied slew rate to the gate driver.

15. The display apparatus of claim 14, wherein the slew rate of the gate clock signal increases as a distance from the timing controller to the stages of the gate driver increases.

16. A display apparatus, comprising:

a display panel comprising a first pixel and a second pixel connected to a same data line;

a timing controller configured to vary a slew rate of a data voltage to be output to the display panel according to a position in the display panel at which the data voltage is to be applied and according to an image pattern displayed on the display panel;

a gate driver configured to output a gate signal to the display panel; and a data driver configured to output the data voltage to the same data line, wherein a first distance between the first pixel and the data diver is less than a second distance between the second pixel and the data driver, and wherein the slew rate of the data voltage applied to the first pixel is less than the slew rate of the data voltage applied to the second pixel, and wherein the timing controller is configured to decrease the slew rate of the data voltage in response to the data voltage being output to the same data line repetitively increasing and decreasing according to the image pattern displayed on the display panel.

17. A display apparatus, comprising:

a display panel;

a timing controller configured to vary a slew rate of a gate signal to be output to the display panel according to a position in the display panel at which the gate signal is to be applied;

a gate driver configured to output the gate signal having the varied slew rate to the display panel; and a data driver configured to output a data voltage to the display panel, wherein the display panel is configured to display a grayscale in response to the gate signal having the varied slew rate and the data voltage, wherein the gate driver comprises a plurality of stages, wherein the timing controller is further configured to vary a slew rate of a gate clock signal according to a position of the stages, and output the clock signal having the varied slew rate to the rate driver, and wherein the slew rate of the gate clock signal increases as a distance from the timing controller increases.

18. The display apparatus of claim 17, wherein the gate driver is integrated on the display panel.

19. A display apparatus, comprising:

a display panel;

a timing controller configured to vary a slew rate of a data voltage to be output to the display panel according to a position in the display panel at which the data voltage is to be applied;

a gate driver configured to output a gate signal to the display panel; and a data driver configured to output the data voltage having the varied slew rate to the display panel, wherein the display panel is configured to display a grayscale in response to the gate signal and the data voltage having the varied slew rate, the varied slew rate, and wherein the slew rate of the data voltage nonlinearly increases as a distance from the data driver increases, and a change of the increase of the slew rate of the data voltage increases as the distance from the data driver increases.

* * * * *